United States Patent [19]

Yoshida et al.

[11] Patent Number: 4,566,751

[45] Date of Patent: Jan. 28, 1986

[54] DISTRIBUTOR CAP WITH IGNITION CABLE

[75] Inventors: Ryuichi Yoshida; Shigeru Suzuki; Hirotoshi Koishikawa, all of Suzuka; Yoshimi Miyamoto, Toyota; Kazuhide Kawai, Oobu, all of Japan

[73] Assignee: Tokai Electric Wire Company Limited, Japan

[21] Appl. No.: 685,920

[22] Filed: Dec. 26, 1984

[30] Foreign Application Priority Data

Dec. 27, 1983 [JP] Japan ..... 58-203320[U]

[51] Int. Cl.[4] ..... H01R 4/24; H01R 13/44

[52] U.S. Cl. ..... 339/218 S; 339/26

[58] Field of Search ..... 339/26, 218 S, 223 S

[56] References Cited

U.S. PATENT DOCUMENTS

| | | | |
|---|---|---|---|
| 2,035,947 | 3/1936 | Davis, Jr. | 339/223 S |
| 3,842,387 | 10/1974 | Santangelo | 339/218 S |
| 3,914,003 | 10/1975 | Loy | 339/218 S |
| 4,437,719 | 3/1984 | Miyamoto | 339/26 |

*Primary Examiner*—Gil Weidenfeld
*Assistant Examiner*—Gary F. Paulmen
*Attorney, Agent, or Firm*—Ernest A. Beutler

[57] ABSTRACT

A distributor cap for use in an internal combustion engine includes the ignition cable 5 having at one end thereof a terminal member 9. A bonding member 10 is molded from a hot-melt adhesive resin such as to bury both the terminal member and a portion of the ignition cable in the vicinity of the one end. A connecting member 11 is integrally secured to the bonding member, the connecting member being molded from a resin having the same quality as that of the resin employed to form the distributor cap. The connecting member is adapted to receive a longitudinally intermediate portion of the terminal member such that a distal end portion 9'' of the terminal member is exposed to the outside. A tower portion 4 of the distributor cap is formed with a recess 15 which receives the connecting member. Further, the connecting member is fitted into the recess and is integrally welded to the tower portion.

6 Claims, 14 Drawing Figures

DISTRIBUTOR CAP WITH IGNITION CABLE

FIELD OF THE INVENTION

The present invention relates to a distributor cap and, more particularly, to a distributor cap with an ignition cable.

BRIEF DESCRIPTION OF THE DRAWINGS

Throughout the drawings, like members are denoted by like reference numerals.

DESCRIPTION OF THE PRIOR ART

Figure 1:
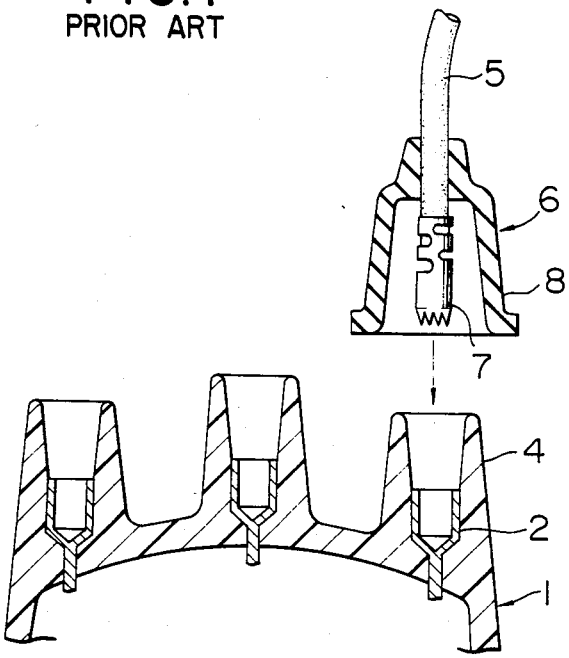
FIG. 1 PRIOR ART
FIG. 1 is a sectional view of one example of conventional distributor caps.

In general, a distributor cap for ignition of an internal combustion engine and an ignition cable are connected together in the following manner. As exemplarily shown in FIG. 1, a distributor cap 1 is formed with a tower portion 4 having an aluminum socket 2 mounted in the recess formed therein. An ignition cable 5 has a terminal portion 6 molded as a separate member. The ignition cable 5 is connected to the distributor cap 1 by fitting the terminal portion 6 onto the tower portion 4. It is to be noted that, in the Figure, the reference numeral 7 denotes a terminal attached to an end portion of the ignition cable 5, while the numeral 8 represents a protective rubber cap 8.

The conventional distributor cap having the above-described structure, however, suffers the following disadvantages: the number of parts and the number of connections are relatively large, which makes it difficult to ensure the requisite quality and reliability of the assembly of the distributor cap and the ignition cable; and it is easy for anyone to attach and detach the ignition cable in relation to the distributor cap, which fact involves the fear of accidents occurring as the result of incomplete fitting of the ignition cable.

Figure 2:
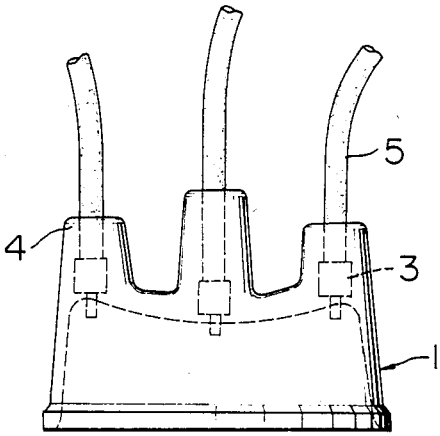
FIG. 2 PRIOR ART
FIG. 2 is a front elevational view of another example of conventional distributor caps.

In order to improve the above-described prior art, another type of distributor cap has been proposed in which, as shown in FIG. 2, the distributor cap 1 is integrally molded with the ignition cable 5 having a terminal member 3 attached to an end portion thereof.

In this prior art constituted by an integral structure, however, the distributor cap 1 is formed from, for example, denatured polypropylene or epoxy resin, while the sheathing member of the ignition cable 5 is formed from, for example, EPDM (ethylene-propylene(diene mixture), chlorinated polyethylene, chlorosulfonated polyethylene, silicone resin or chloroprene. In consequence, the difference in material composition of the distributor cap 1 and the ignition cable 5 makes it difficult for them to firmly adhere to each other and, therefore, this type of distributor cap is disadvantageously inferior in its sealing performance.

SUMMARY OF THE INVENTION

It is a primary object of the present invention to provide a distributor cap with an ignition cable which can overcome the above-described disadvantages of the prior arts, is excellent in its sealing performance and in which the ignition cable is firmly secured the distributor cap such that it forms a structure which is integral with the cap.

To this end, according to the present invention, there is provided a distributor cap comprising: an ignition cable having at one end thereof a terminal member; a bonding member molded from a hot-melt adhesive resin such as to bury both the terminal member and a portion of the ignition cable in the vicinity of the one end; a connecting member integrally secured to the bonding member and molded from a resin having the same quality as that of the resin employed to form the distributor cap, the connecting member receiving a longitudinally intermediate portion of the terminal member such that a distal end portion of the terminal member is exposed to the outside; and a tower portion formed with a recess which receives the connecting member, the connecting member being fitted into the recess and is integrally welded to the tower portion.

The above and other objects, features and advantages of the present invention will become clear from the following description of the preferred embodiments thereof, taken in conjunction with FIGS. 3 to 12.

DETAILED DESCRIPTION OF THE PREFERRED EMBODIMENTS

The present invention will be described hereinunder in detail through embodiments with reference to the accompanying drawings infra FIG. 3.

Figure 3A:
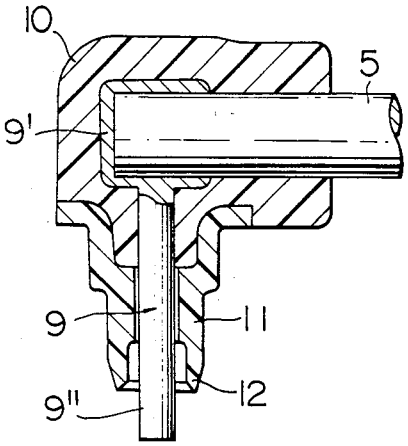
FIG. 3A is a sectional front elevational view of a distributor cap with an ignition cable in accordance with a first embodiment of the present invention, particularly showing the construction of a portion thereof in the vicinity of an end portion of the ignition cable.
Figure 3B:
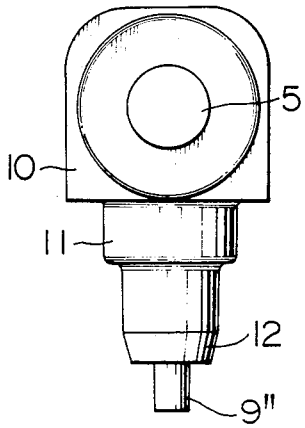
FIG. 3B is a side elevational view of the portion of the distributor cap shown in FIG. 3A.
Figure 4A:
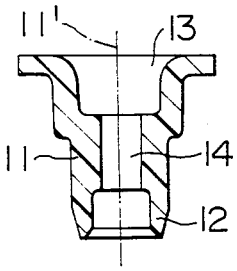
FIG. 4A is a sectional front elevational view showing the construction of a connecting member of the distributor cap in accordance with the first embodiment.
Figure 4B:
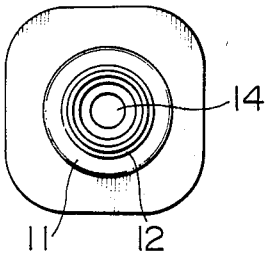
FIG. 4B is a bottom view of the portion of the distributor cap shown in FIG. 4A.
Figure 5:
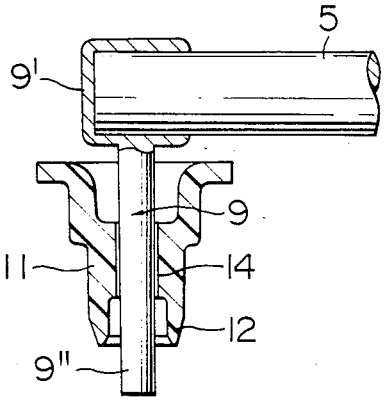
FIG. 5 is a sectional front elevational view showing how the connecting member receives a terminal member in the first embodiment.

Referring first to FIGS. 3 to 8 which in combination show a first embodiment of the invention, a terminal member 9 of a metal, such as aluminum, is, as shown in FIG. 3A, attached to an end portion of the ignition cable 5, the terminal member 9 constituting an electrode of the ignition cable 5. A bonding member 10 is formed by means of molding such as to bury an attaching portion 9' of the terminal member 9 at which it is attached to the ignition cable 5, together with a portion of the ignition cable 5 in the vicinity of the attaching portion 9'. The bonding member 10 is provided in order to improve the sealing between the distributor cap and the ignition cable 5. The bonding member 10 is formed by molding a hot-melt adhesive resin (a resin which offers an adhesive effect on heating, e.g., Bondfast (trademark) G, manufactured by Sumitomo Chemical Co., Ltd.), such as denatured polypropylene or denatured polyethylene. It is to be noted that the molding is preferably effected under pressure in order to improve the adhesion of the bonding member 10 to the sheathing material of the ignition cable 5. The bonding member 10 receives the terminal member 9 such as to bury a longitudinally intermediate portion of the terminal member 9 with only a distal end portion 9'' exposed to the outside. Moreover, a connecting member 11 is integrally secured to the bonding member 10, the connecting member 11 being molded from a resin having the same quality as that of the resin employed to form the distributor cap, as is described hereinunder. More specifically, referring to FIGS. 4 and 5, the connecting member 11 has been previously formed, as a separate member, from a resin having the same quality as that of a resin employed to form the distributor cap. The connecting member 11 is provided in the upper portion thereof with a fitting recess 13 which receives a fitting portion of the bonding member 10. The connecting member 11 is further provided with a receiving bore 14 which receives the terminal member 9, the receiving bore 14 being formed along the longitudinal axis 11' of the connecting member 11. Additionally, the connecting member 11 is provided at the lower end thereof with an annular retainer piece 12 extending vertically downward as viewed in the figures, the retainer piece 12 being adapted to secure the connecting member 11 to a tower portion of the distributor cap. The connecting member 11 constructed as described above is, as shown in FIG. 5, fitted on the terminal member 9 attached to the end portion of the ignition cable 5 in such a manner that the receiving bore 14 receives the intermediate portion of the terminal member 9, whereby the connecting member 11 and the end portion of the ignition cable 5 are assembled together. The end portion of the ignition cable 5 in the above-described assembled state is inserted into a molding tool in order to mold the bonding member 10 which buries both the attaching portion 9' of the terminal member 9 and the portion of the ignition cable 5 in the vicinity of the attaching portion 9' and integrally adheres to the connecting member 11.

Figure 6:
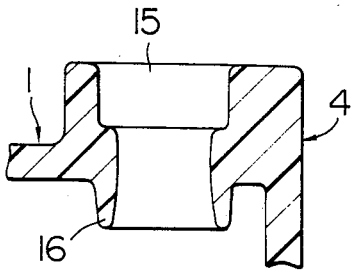
FIG. 6 is a sectional front elevational view showing the construction of a tower portion in the first embodiment.
Figure 7:
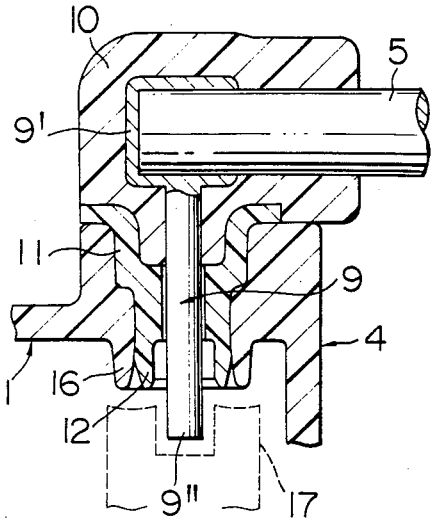
FIG. 7 is a sectional front elevational view showing how end portion of the ignition cable and the tower portion are assembled together in the first embodiment.
Figure 8:
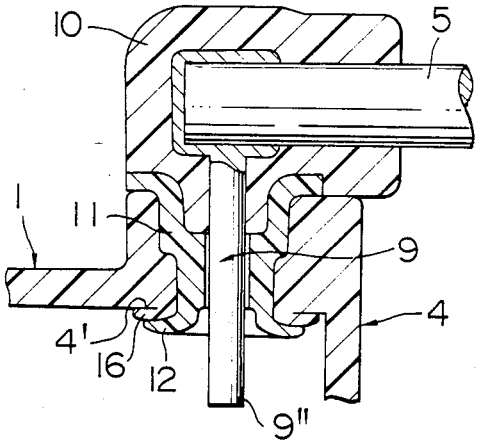
FIG. 8 is a sectional front elevational view showing the construction of the first embodiments as a whole.

On the other hand, the distributor cap 1 is formed, as a separate member, from a resin having the same quality as that of a resin employed to form the connecting member 11. The tower portion 4 of the distributor cap 1 is, as shown in FIG. 6, provided with a reces 15 which tightly receives the connecting member 11. The tower portion 4 is further provided at the lower end of the recess 15 with an annular weldable piece 16 projecting downwardly (as viewed in FIG. 6). The arrangement is such that, when the connecting member 11 at the end portion of the ignition cable 5 is fitted into the recess 15 as shown in FIG. 7, the weldable piece 16 overlaps the retainer piece 12 of the connecting member 11 such that they are in contact with each other at their respective inner and outer peripheral surfaces.

Thus, the ignition cable 5 and the distributor cap 1 arranged as described above are assembled together, with the connecting member 11 at the end portion of the ignition cable 5 fitted into the recess 15. Then, an ultrasonic welding bore 17 is brought into contact with the retainer piece 12 and the weldable piece 16 from the lower side thereof as shown by the dotted line in FIG. 7, whereby ultrasonic treatment is applied such that the retainer piece 12 and the weldable piece 16 are softened and deformed outwardly. Thus, the retainer piece 12 and the weldable piece 16 formed on softening press against a lower edge 4' of the tower portion 4. At the same time, the retainer piece 12, the weldable piece 16 and the lower edge 4', which are formed from resins having the same quality, are welded together, thereby effecting "weld-caulking". As a result, the connecting member 11 and the tower portion 4 are mechanically firmly secured to each other such as to form an integral structure.

According to the present invention arranged as described above, the ignition cable 5 buried in the bonding member 10 is completely bonded to the bonding member 10 by means of heating and pressure applied in the molding operation. Thus, the ignition cable 5 is sealed sufficiently and in the way that is required. Moreover, since the ignition cable 5 is secured by welding to the tower portion 4 of the distributor cap 1 through the connecting member 11 integrally secured to the bonding member 10, the connection between the connecting member 11 and the tower portion 4 is given a sealing performance and a mechanical bonding strength which are sufficient and which fulfill requirements. Thus, it is possible to completely connect together the ignition cable 5 and the distributor cap 1 such that they form an integral structure. Further, in the distributor cap provided in accordance with the present invention, it is necessary to insert only once the end portion of the ignition cable 5 into the molding tool. It is, therefore, advantageously possible to form a distributor cap with an ignition cable with ease and at low cost.

Figure 9:
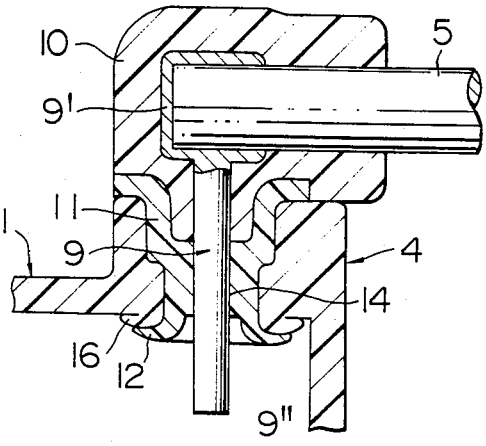
FIGS. 9 to 12 respectively show distributor caps in accordance with second to fifth embodiment of the present invention, these Figures being similar to FIG. 8.
Figure 10:
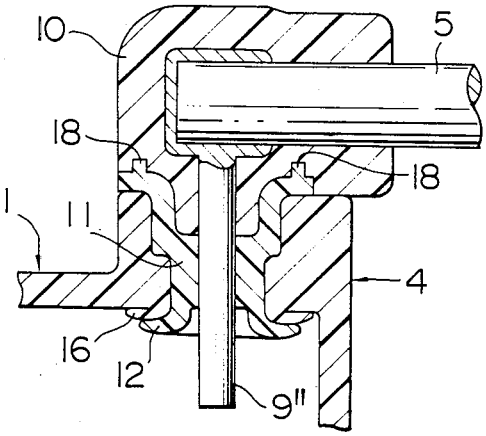

FIG. 9 shows a second embodiment of the present invention. The second embodiment is arranged such that, in a distributor cap with an ignition cable including the bonding member 10 and the connecting member 11 which respectively have the same constructions as those in the first embodiment, the terminal member 9 and the receiving bore 14 in the connecting member 11 are press-fitted to each other, thereby expelling the air from the area therebetween. Accordingly, it is possible to prevent the occurrence of a corona discharge at the portion concerned and, consequently, it is advantageously possible to prevent any dielectric breakdown due to corona discharge. On the other hand, according to a third embodiment shown in FIG. 10, pin-shaped retainer projections 18 are provided such as to project from the bonding surface of the connecting member 11 at which it is bonded to the bonding member 10, these members 10, 11 being the same as those in the first embodiment, and the bonding member 10 is molded such that the retainer projections 18 are buried therein. The existence of the retainer projections 18 makes it possible to increase the adhesion between the bonding member 10 and the connecting member 11. Accordingly, if a turning force, for example, acts on the end portion of the ignition cable such as to distort the connecting member 11, any damage to the bonding surface is prevented by virtue of the excellent adhesion. Thus, it is possible to stabilize the function of the end portion of the ignition cable.

It is to be noted that the fixing by means of welding between the connecting member 11 and the recess 15 in the present invention is not exclusively effected by the retainer piece means in the above-described embodiment and may be effected by other welding means. For example, an arrangment may be employed wherein the outer peripheral surface of the connecting member 11 and the inner peripheral surface of the recess 15 are respectively formed with small annular steps which are engageable with each other, and the small steps are welded together by an ultrasonic treatment.

Figure 11:
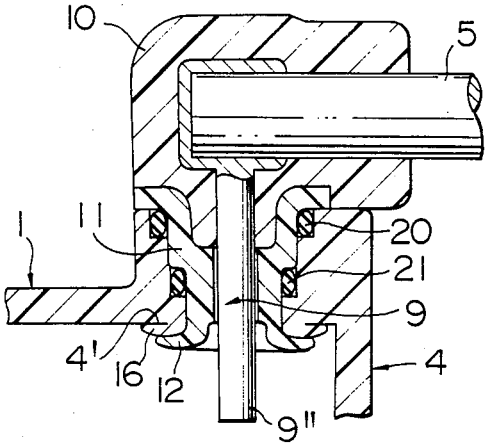

FIG. 11 shows a fourth embodiment of the present invention. According to this embodiment, O-rings 20, 21 are interposed between the connecting member 11 and the tower portion 4 in the first embodiment. By so doing, it is possible to improve the waterproofness.

Figure 12:
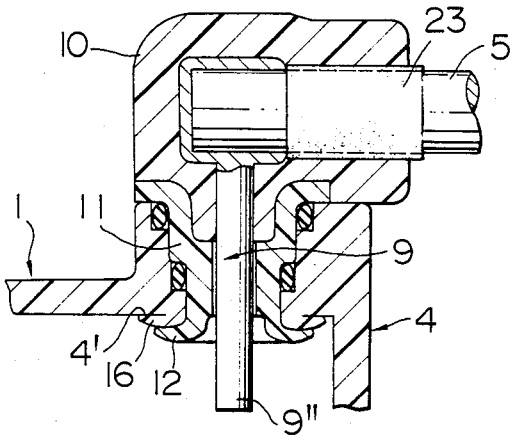

FIG. 12 shows a fifth embodiment of the present invention. In this embodiment, an EPDM rubber tube 23 is employed to coat a portion of the sheath of the ignition cable 5 in the fourth embodiment which is in contact with the bonding member 10. According to this arrangement, when the sheath of the ignition cable 5 is formed from a silicone rubber in order to improve the heat resistance, it is possible to allow the sheath and the bonding member 10 is adhere excellently to each other through the tube 23. It is to be noted that the tube 23 is a heat-shrinkable tube which is coated at its inner surface with a silicone adhesive.

As has been described above, the present invention provides a distributor cap with an ignition cable which can overcome the disadvantages of the prior arts, is excellent in its sealing performance and in which the ignition cable is completely secured to the distributor cap such as to form a structure integral with the cap.

What is claimed is:

1. A distributor cap comprising:

an ignition cable having at one end thereof a terminal member;

a bonding member molded from a hot-melt adhesive resin such as to bury a portion of both of said terminal member and said ignition cable therein in the vicinity of said one end;

a connecting member, which is not molded from the same body of material as said bonding member integrally secured to said bonding member, said connecting member receiving a longitudinally intermediate portion of said terminal member such that a distal end portion of said terminal member is exposed to the outside of said connecting member; and a tower portion, which is not molded from the same bodies of material as said bonding member and said connecting member, formed with a recess which receives said connecting member, and molded from a resin having the same quality as that of the resin employed to form said connecting portion, said connecting member being fitted into said recess and is integrally welded to said tower portion.

2. A distributor cap according to claim 1, wherein said bonding member is formed from at least one hot-melt adhesive resin selected from the group consisting of denatured polypropylene and denatured polyethylene.

3. A distributor cap according to claim 1, wherein the intermediate portion of said terminal member is received in said connecting member without any gap.

4. A distributor cap according to claim 1, wherein a retainer projection is provided at a portion of said connecting member at which it is bonded to said bonding member, and said bonding member is molded such as to bury said retainer projection.

5. A distributor cap according to claim 1, wherein an O-ring is interposed in the bonding area between said connecting member and said tower portion.

6. A distributor cap according to claim 1, wherein a portion of said ignition cable at which it is bonded to said bonding member is coated with an EPDM rubber tube.

* * * * *